United States Patent [19]

Teirlinck

[11] Patent Number: 4,872,921

[45] Date of Patent: Oct. 10, 1989

[54] SHEETS OF ALUMINIUM ALLOY CONTAINING MAGNESIUM, SUITABLE FOR PRODUCING BODIES OF CANS BY DRAWING AND IRONING, AND METHOD OF OBTAINING SAID SHEETS

[75] Inventor: Didier Teirlinck, St. Egreve, France

[73] Assignee: Cegedur Societe de Transformation de 1'Aluminium Pechiney, Paris, France

[21] Appl. No.: 199,796

[22] Filed: May 27, 1987

[30] Foreign Application Priority Data

Jun. 24, 1987 [FR] France ..... 87 09271

[51] Int. Cl.[4] ..... C22F 1/04

[52] U.S. Cl. ..... 148/2; 148/3; 148/11.5 A; 148/439; 148/440

[58] Field of Search ..... 148/2, 3, 11.5 A, 437–440

[56] References Cited

U.S. PATENT DOCUMENTS 3,930,895 1/1976 Moser et al. ..... 148/11.5 A

*Primary Examiner*—R. Dean

*Attorney, Agent, or Firm*—Dennison, Meserole, Pollack & Schneiner

[57] ABSTRACT

The invention relates to sheets of aluminium alloy containing magnesium, suitable for producing bodies of cans by drawing and ironing, and a method of obtaining said sheets.

The sheets are characterized in that they have, over 10 to 25% of their surface, uniformly distributed particles formed by amorphous aluminium oxides and crystalline magnesium and aluminium oxides, in the form of flat discs less than 5 microns thick and with a mean diameter distributed round a means value from 2 to 15 microns.

One of the methods of obtaining said sheets is characterized in that the strip is taken as it comes from the casting machine or after at least one rolling pass and subjected to chemical etching so as to reduce its thickness by a maximum of 2 microns, before being annealed in air at from 330° to 450° C. for at least 30 minutes.

The invention can be applied to the production of bodies of cans for fizzy or non-fizzy drinks, from metal sheets which do not stick in the drawing process, using a wide range of alloys.

13 Claims, 1 Drawing Sheet

Figure 1:
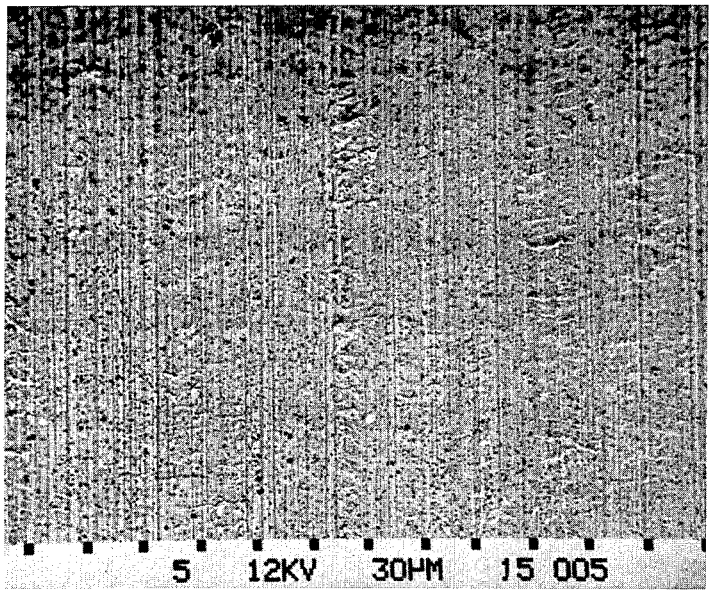

SHEETS OF ALUMINIUM ALLOY CONTAINING MAGNESIUM, SUITABLE FOR PRODUCING BODIES OF CANS BY DRAWING AND IRONING, AND METHOD OF OBTAINING SAID SHEETS

The invention relates to sheets of aluminium alloys containing magnesium, suitable for producing bodies of cans by drawing and ironing, and a method of obtaining said sheets.

A person skilled in the art knows that aluminium alloys can be cast continuously, directly in strip form, in belt or cylinder type machines such as that described in French Pat. No. 1198006. The strips may be up to 2 meters wide and are generally from 5 to 30 mm thick. The advantage of this type of casting over casting in very thick plates is that it avoids a large number of rolling passes.

The strips thus obtained can be given smaller thicknesses, of down to a few microns, by a series of cold or hot rolling operations which may or may not alternate with annealing operations. In particular, in cases where they are intended for the manufacture of bodies of cans, used e.g. for packing fizzy or non-fizzy drinks, the strips are converted to sheets a few hundred microns thick, circular discs are cut out of the sheets and converted to a cup by drawing and the combined action of a punch and die; after a so-called ironing operation to make the walls thinner the cup can be used as the body of a can.

The change in shape from a flat disc to the body of a can involves exerting strong forces and, particularly in the drawing process, accompanied by a sticking, or "galling" phenomenon which can be defined as adhesion of a soft metal to a hard one. In the present case aluminium particles are removed from the surface of the sheet and adhere to the surface of the drawing tool, which is made of tungsten carbide. The particles, which are very hard drawn and therefore hard, make cracks appear on the body of the can, which reduce its mechanical strength, may even make it break, and in any case spoil its appearance.

Several methods have been recommended for avoiding this sticking and giving the bodies of cans a suitable attractive appearance.

Thus U.S. Pat. No. 3,930,895, using a type 3004 alloy as defined by the Aluminium Association, i.e. made up of Si 0.3%, Fe 0.5%, Cu 0.25%, Mn 1 to 1.5%, Mg 0.8 to 1.3%, Zn 0.25%, balance Al, attributes the difficulties encountered to the fact that continuous casting between cylinders leads to the formation of Al-Mn particles with dimensions less than 2 microns; these are too small to have a cleaning effect on the tools and hence contribute towards dirtying them. It quotes the fact that, in the treatment of such an alloy obtained in plates by conventional casting, the particles have dimensions from 15 to 20 microns, so there is no dirtying. But since the inventor nevertheless wants to have the advantages of continuous casting between cylinders, particularly as far as uniformity of the microstructure is concerned, he recommends increasing the size of the particles by modifying the composition of alloy 3004, through bringing the manganese content within the 2 to 3% range.

U.S. Pat. No. 4,111,721 also finds this galling phenomenon on sheets of 3004 and 3003 and agrees that the dimensions of the Al-Mn and Al-Mn-Fe particles have to be increased to eliminate it. However, it teaches that this should be done not by modifying the composition but by applying heat treatment, preferaby at a temperature of 620° C., for a period of from 16 to 24 hours; the treatment may be applied either to the strip as cast or to the strip when it has already undergone a first series of rolling passes.

French Pat. No. 2 505 365 again proposes modifying the composition of the alloy used, not in respect of the manganese but in respect of the silicon, which it brings into the 0.3–0.6% by weight range.

French Pat. No. 2 525 047 filed by applicants recommends quite a different solution, comprising mechanically cleaning the surface of the strip and modifying it by heating in air.

Although such processes have greatly reduced the sticking phenomenon, they have nevertheless not eliminated it completely. Hence applicants, in their research on solving the problem, have found that sheets which are subjected to drawing and ironing have a special surface condition, and that this condition can be obtained with aluminium alloys of very different compositions provided they have a common point, namely the presence of magnesium.

This special condition is characterised in that the sheets have, over 10–25% of their surface, uniformly distributed particles, formed by amorphous aluminium oxides and crystalline magnesium and aluminium oxides, in the form of flat discs less than 5 microns thick and with a mean diameter widely distributed round a mean value of from 2–15 microns.

Thus according to the invention suitability for drawing and ironing is, as taught by U.S. Pat. No. 3,930,895, linked with the presence of particles of relatively large dimensions, coming close to those observed in plates. However, the similarity stops there, for the particles here are very different from the point of view of distribution, composition and shape. In fact:

the particles are not distributed right through the sheet but only over the surface, and furthermore only over a portion of the surface.

the particles are not made up of intermetallics of the Al-Mn or Al-Mn-Fe type but of magnesium and aluminium oxides which are both amorphous and crystalline.

the particles have a very special shape: that of flat discs of a thickness limited to 5 microns and a mean diameter widely distributed round a mean value from 2–15 microns.

The particles of the invention can be recognised particularly by examining the metal sheet with an electron microscope operating by transmitted light, where they appear in the form of large clusters of a black colour, regularly dispersed in a lighter matrix; micro analysis shows them to be made up essentially of amorphous and crystalline aluminium and magnesium oxides.

For the particles to be obtained, the starting alloy must therefore contain magnesium. However, a magnesium content as low as 0.1% by weight is perfectly adequate, while contents of up to 5% do not prevent the result from being obtained. But it should be realised that the invention can be applied to alloys also containing up to 2% of manganese and/or 1.5% of silicon, to which elements there can be added at least one of the following: Cu, Zn, Cr, Fe up to a respective content of 0.5%, 0.5%, 0.5% and 0.7% by weight, also refining elements such as Ti and B up to 0.1% by weight for each.

Thus a sheet of aluminium alloy defined as 3004 in the Aluminium Association's standards, i.e. containing by weight: Mg 0.8–1.3%; Mn 1.0–1.5%; Si 0.3%; Fe 0.7%, Cu 0.25%, Zn 0.25% and with a surface according to the invention, has produced over 200,000 cans with the same tooling equipment, without any breakages or grooves being found.

Similarly a reference 5182 alloy, i.e. an alloy containing 4.0–5.0% Mg; Si 0.20%; Cu 0.15%; Zn 0.25%., Fe 0.35% by weight and of the structure claimed also enabled large numbers of cans to be produced without trouble.

It should be noted that sheets of aluminium alloys charged with magnesium, which applicants have adapted for drawing and ironing in accordance with the invention, have the enormous advantage of improved tensile strength over sheets made of manganese alloys; they make it possible to envisage reductions in thickness and thus improve the cost price of the cans.

To illustrate the invention, 2 figures which are micrographs of the surface of sheets with 300-fold magnification are included in this application.

FIG. 1 corresponds to a sheet of alloy 3004 which did not have any particles and, when ironed, gave rise to breakages from the formation of the 1000th can body.

Figure 2:
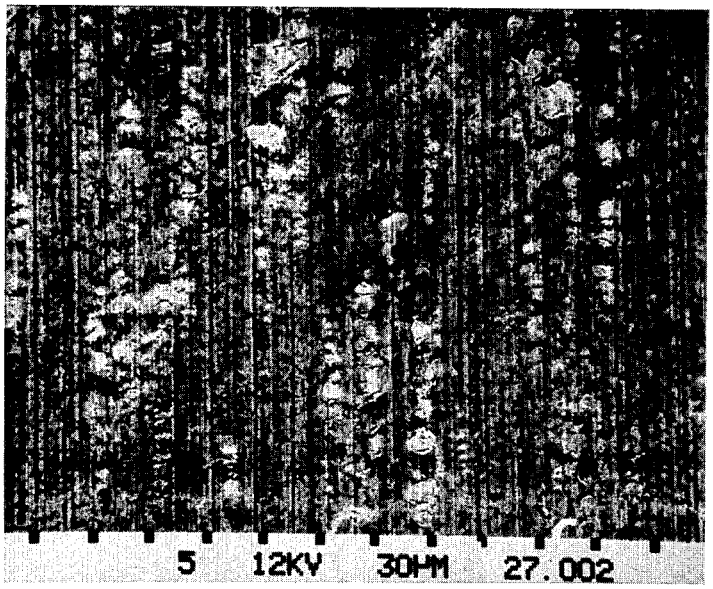

FIG. 2 corresponds to a sheet of the same alloy with particles according to the invention, which has enabled over 200,000 bodies of cans to be produced without any grooves.

The invention also concerns a method of obtaining said sheets. It is characterised in that the strip is taken either straight from the casting machine or after at least one rolling pass, and subjected to chemical etching so as to reduce its thickness by a maximum of 2 microns, before being annealed in air at from 330° and 450° C. for at least 30 minutes. The etching conditions are preferably chosen so as to give a reduction in thickness of from 0.8 to 1 micron.

It is indeed known to etch aluminium strips resulting from continuous casting with caustic soda. German Pat. No. DE 2 418 642 can be quoted in this connection. However, the essential purpose of this patent is to eliminate irregularities in the strip, in the form of segregations, pores and other similar faults which have very troublesome effects on metal strips, particularly when the strips are later converted to sheets, belts or thin sheets. This involves relatively strong etching, since the patents state that the quantity of material removed is from 10 to 100 g/m$^2$, which corresponds to a thickness of 3.7 to 37 microns. This type of etching has nothing to do with that in the invention and it is not moreover designed to prevent sticking in the process of ironing bodies of cans.

Applicants have made the surprising discovery that slight etching reveals hard zones on the surface of the strip which, after being annealed in air at from 330° to 450° C. for at least 30 minutes, have particles as described above and hence have the effect of:

reducing the coefficient of friction by hardening the surface, reducing adhesion between tool and alloy, permanently cleaning the drawing ring, thus giving the metal a releasing or self-cleaning action.

Etching may be effected by any etching agent but preferably a solution containing from 0.1 to 10 g/l of NaOH; the strip is submerged in it long enough not to remove more than 2 micron thickness of metal. The etching time depends on the composition of the alloy used and the rolling operations undergone by the strip. Etching can be carried out at ambient temperature, i.e. at around 20° C., although it can take place at any temperature below 100° C. in order to shorten the treatment. The 70°–80° C. range is preferable.

Additional tests have shown that the results could be further improved by brushing as in French Patent No. 2 525 047, after the etching of the strip and before annealing. The brushing appears to have the effect of improving the distribution of hard zones in the whole surface of the strip and consequently generating more homogeneous non-stick surfaces.

Optimum annealing conditions are obtained within the temperature range from 350° to 400° C. and the time range from 1 to 2 hours.

The invention can be illustrated by the following example:

A strip 1100 mm wide, 8 mm thick and of the following composition by weight:

| Si | Fe | Cu | Mn | Mg | Ti | Al |
|---|---|---|---|---|---|---|
| 0.28 | 0.42 | 0.10 | 1.00 | 1.05 | 0.02 | Balance |

is obtained by casting between cylinders.

It undergoes the following conversion sequence:

homogenisation at 600° C. for 10 hours cold rolling to 2.7 μm annealing for 2 hours at 350° C.

cold rolling to 1.2 m etching: 45 seconds in a 5 g/l solution of NaOH at 70° C. so as to remove a metal thickness of 0.8 microns brushing annealing for 2 hours at 400° C.

cold rolling to 0.33 mm.

The metal is then used to make bodies of cans 66 mm in diameter and with a mean height of 130 mm, by drawing and ironing.

In a series of 200,000 cans none have any grooves.

On the other hand, metal which has undergone the same conversion sequence without any etching does not produce cans without grooves; after the first 500 cans the grooves increase with the number of cans produced, and after 1,000 the walls of the can bodies are found to break.

I claim:

1. Sheets of aluminum alloy containing about 0.1 to 5% by weight magnesium suitable for producing bodies of cans for fizzy or non-fizzy drinks by drawing and ironing, obtained by strip casting, followed by heat treatments and rolling passes, said sheets comprising over 10 to 25% of their surface, uniformly distributed particles of amorphous aluminum oxides and crystalline magnesium and aluminum oxides, in the form of flat discs less than 5 microns thick and having diameters distributed around a mean value from 2 to 15 microns.

2. The sheets of claim 1, containing at least one of the elements Mn up to 2% by weight and Si up to 1.5% by weight.

3. The sheets of claim 2, containing at least one of the elements Cu up to 0.5% by weight, Zn up to 0.5% by weight, Cr up to 0.5% by weight, and Fe up to 0.7% by weight.

4. The sheets of claims 1, 2 or 3 containing up to 0.1% of boron and 0.1% of titanium by weight.

5. A method of producing sheets of aluminum alloy containing 0.1 to 5% by weight mangesium comprising taking strip of said alloy as it comes from a casting machine or after at least one rolling pass, subjecting said strip to chemical etching so as to reduce its thickness by a maximum of 2 microns, and annealing in air at from 330° to 450° C. for at least 30 minutes, to produce sheets of said alloy having, over 10 to 25% of their surface, uniformly distributed particles of amorphous aluminum oxides and crystalline magnesium and aluminum oxides, in the form of flat discs less than 5 microns thick and having diameters distributed around a mean value of 2 to 15 microns.

6. The method of claim 5, wherein the reduction in thickness is from 0.8 to 1 micron.

7. The method of claim 5, wherein etching is effected with a sodium hydroxide solution.

8. The method of claim 7, wherein the sodium hydroxide solution is at a concentration of from 0.1 to 10 g/l.

9. The method of claim 5, wherein etching is effected at a temperature from 20° to 100° C.

10. The method of claim 9, wherein the temperature is from 70° to 80° C.

11. The method of claim 5, additionally comprising brushing between the said etching and said annealing.

12. The method of claim 5, wherein annealing is carried out at from 350° to 400° C.

13. The method of claim 5, wherein the annealing period is from 1 to 2 hours.

* * * * *